US008206061B1

(12) United States Patent
Hansen et al.

(10) Patent No.: US 8,206,061 B1
(45) Date of Patent: Jun. 26, 2012

(54) ECCENTRIC VIBRATORY WEIGHT SHAFT FOR UTILITY COMPACTOR

(75) Inventors: Eric Arden Hansen, Big Lake, MN (US); Kevin J. Magee, Buffalo, MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/116,106

(22) Filed: May 26, 2011

(51) Int. Cl.
*E01C 19/28* (2006.01)

(52) U.S. Cl. ..... 404/128; 404/130

(58) Field of Classification Search ..... 404/122, 404/128, 130, 133.05; 74/84 R
See application file for complete search history.

(56) References Cited

U.S. PATENT DOCUMENTS

| | | | | |
|---|---|---|---|---|
| 4,113,403 | A | 9/1978 | Tertinek et al. | |
| 4,367,054 | A * | 1/1983 | Salani et al. | 404/117 |
| 4,411,081 | A * | 10/1983 | King | 404/121 |
| 4,619,552 | A * | 10/1986 | Sadahiro | 404/117 |
| 4,632,599 | A * | 12/1986 | Sadahiro | 404/124 |
| 5,341,057 | A | 8/1994 | Yamaguchi et al. | |
| 5,857,388 | A | 1/1999 | Killion et al. | |
| 5,934,825 | A | 8/1999 | Waldenberger | |
| 6,237,442 | B1 | 5/2001 | Killion | |
| 6,241,420 | B1 | 6/2001 | Perrin et al. | |
| 6,402,424 | B2 * | 6/2002 | Mitsui | 404/117 |
| 6,516,679 | B2 * | 2/2003 | Yates et al. | 74/87 |
| 6,558,072 | B2 | 5/2003 | Staffenhagen et al. | |
| 6,561,729 | B1 | 5/2003 | Potts | |
| 6,626,063 | B2 | 9/2003 | Killion | |
| 6,637,280 | B2 | 10/2003 | Potts | |
| 6,837,650 | B2 * | 1/2005 | Magee et al. | 404/132 |
| 2009/0143952 | A1 | 6/2009 | Chisholm et al. | |

FOREIGN PATENT DOCUMENTS

| | | | |
|---|---|---|---|
| EP | 1 103 662 | B1 | 10/2002 |
| WO | WO-2010/096620 | A1 | 8/2010 |

* cited by examiner

*Primary Examiner* — Gary S Hartmann
(74) *Attorney, Agent, or Firm* — Miller, Matthias & Hull

(57) ABSTRACT

A utility compactor is disclosed that includes a roller disposed on top of and connected to a base plate. The roller has two opposing vertical supports. The compactor also includes an eccentric vibratory shaft extending between and rotatably connected to the two vertical supports of the roller. The eccentric vibratory shaft includes a first rotor shaft coaxially spaced apart from a second rotor shaft. The first and second rotor shafts are coupled together by an offset shaft. The offset shaft has an I-beam cross section and includes a first angled portion, a second angled portion and a center portion disposed between and coupling the first and second angled portions together. The first angled portion is coupled to the first rotor shaft; the second angled portion is coupled to the second rotor shaft. The first and second angled portions are angled with respect to a first axis passing through the first and second rotor shafts such that the center portion has a second axis that is offset from and at least substantially parallel to the first axis.

13 Claims, 2 Drawing Sheets

ECCENTRIC VIBRATORY WEIGHT SHAFT FOR UTILITY COMPACTOR

TECHNICAL FIELD

This disclosure relates generally to a system and method for compacting materials, such as vibratory roller compactors or utility compactors. More specifically, this disclosure relates to eccentric vibratory weight shafts for utility compactors and methods for retrofitting existing compactors with the disclosed shafts and methods for compacting materials using the disclosed shafts.

BACKGROUND

Compacting work machines are widely used in the construction and landscaping industries for the compaction of granular materials. Compacting machines come in a variety of forms including vibratory rammers, vibratory plate compactors and vibratory roller (or drum) compactors. This disclosure is directed to vibratory roller compactors, which are also referred to as rollers, articulated rollers, vibratory soil compactors, vibratory asphalt compactors and the term that will be used herein, utility compactors. Applications for such utility compactors include the compaction of sand, gravel, or crushed aggregate for foundations, footings, or driveways; base preparation for concrete slabs, asphalt parking lots, etc. Utility compactors are also used for the compaction of either hot or cold mix asphalt during patching or repairing of streets, highways, sidewalks, parking lots, etc.

The typical utility compactor includes one or two rollers or rollers that perform the actual compacting operation. The rollers are mounted to a main frame that supports an engine and associated equipment. An eccentric shaft, commonly known as an exciter, is located within and rotatably coupled to the roller by a second hydraulic motor. In hot mix asphalt compaction applications, the machine may be provided with a water tank and associated equipment for spraying water on the surface immediately in front of the roller to prevent the asphalt from congealing on the roller.

Utility compactors on the market today exhibit a number of drawbacks and disadvantages. First, the eccentric shaft used to vibrate the roller is very heavy, thereby increasing both manufacturing and operating costs. As shown in FIG. 1, a typical eccentric shaft 5 includes a straight bar 6 extending from one end 7 of the bar 6 to the other end 8, with eccentric weights 9 either press-mounted to, or cast with, the straight bar 6. Both press-fitting weights 9 eccentrically on a straight bar 6 or casting eccentric weights 9 with the straight bar 6 are costly manufacturing practices which, if replaced, could produce substantial cost savings. The current eccentric shaft designs are also heavy and therefore costly to manufacture. For example, for a roller that is 1 m wide, the shaft 5 of FIG. 1 weighs about 26.2 kg and has a first moment of inertia of about 0.24 kg·m and a second moment of inertia (a.k.a. mass moment of inertia) of about 0.034 kg·m$^2$. Further, the ratio of the first to second moments of inertia of the current eccentric shaft is about 7.2 m$^{-1}$ and requires excessive start-up torque to get the shaft rotating, thereby increasing operational costs and wear and tear on the motor that rotates the shaft. For example, the shaft 5 requires about 3.42 N·m over a 4 second start-up time period to get the shaft 5 rotating at a desired frequency of about 65 Hz. Reducing the start-up torque required could also produce substantial cost savings.

As a result, a need has therefore arisen to provide an improved eccentric shaft for a utility compactor lacking some or all the disadvantages described above.

SUMMARY OF THE INVENTION

An eccentric vibratory shaft is disclosed that includes a first rotor shaft coaxially spaced apart from a second rotor shaft. The first and second rotor shafts are coupled together by an offset shaft. The offset shaft includes a first angled portion, a second angled portion and a center portion disposed between and coupling the first and second angled portions. The first angled portion is coupled to the first rotor shaft; the second angled portion is coupled to the second rotor shaft. The first and second angled portions are each angled with respect to a first axis passing through the first and second rotor shafts such that the center portion is offset from and at least substantially parallel to the first axis.

A utility compactor is also disclosed that includes a roller having two opposing vertical supports. The compactor also includes an eccentric vibratory shaft extending between and rotatably connected to the two vertical supports of the roller. The eccentric vibratory shaft includes a first rotor shaft coaxially spaced apart from a second rotor shaft. The first and second rotor shafts are coupled together by an offset shaft. The offset shaft has an I-beam cross section and includes a first angled portion, a second angled portion and a center portion disposed between and coupling the first and second angled portions together. The first angled portion is coupled to the first rotor shaft; the second angled portion is coupled to the second rotor shaft. The first and second angled portions are angled with respect to a first axis passing through the first and second rotor shafts such that the center portion has a second axis that is offset from and at least substantially parallel to the first axis.

A method of reducing the weight of a utility compactor and reducing a start-up torque required to rotate an eccentric vibratory shaft that vibrates the roller of the compactor is disclosed. The disclosed method includes: providing an eccentric vibratory shaft including a first rotor shaft coaxially spaced apart from a second rotor shaft, the first and second rotor shafts being coupled together by an offset shaft, the offset shaft including a first angled portion, a second angled and second angled portions being angled with respect to a first axis passing through the first and second rotor shafts such that the center portion is offset from and at least substantially parallel to the first axis; removing a preexisting eccentric vibratory shaft from the compactor; and replacing the removed preexisting vibratory shaft with the provided eccentric vibratory shaft.

DETAILED DESCRIPTION

Figure 2:
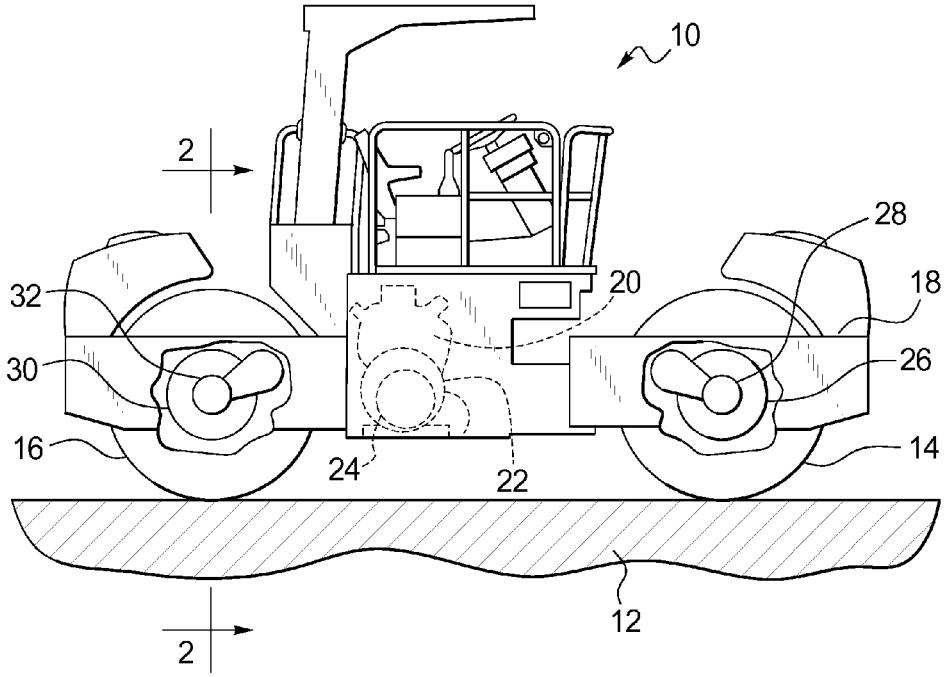
FIG. 2 is a side elevational view of a disclosed compacting work machine.
Figure 3:
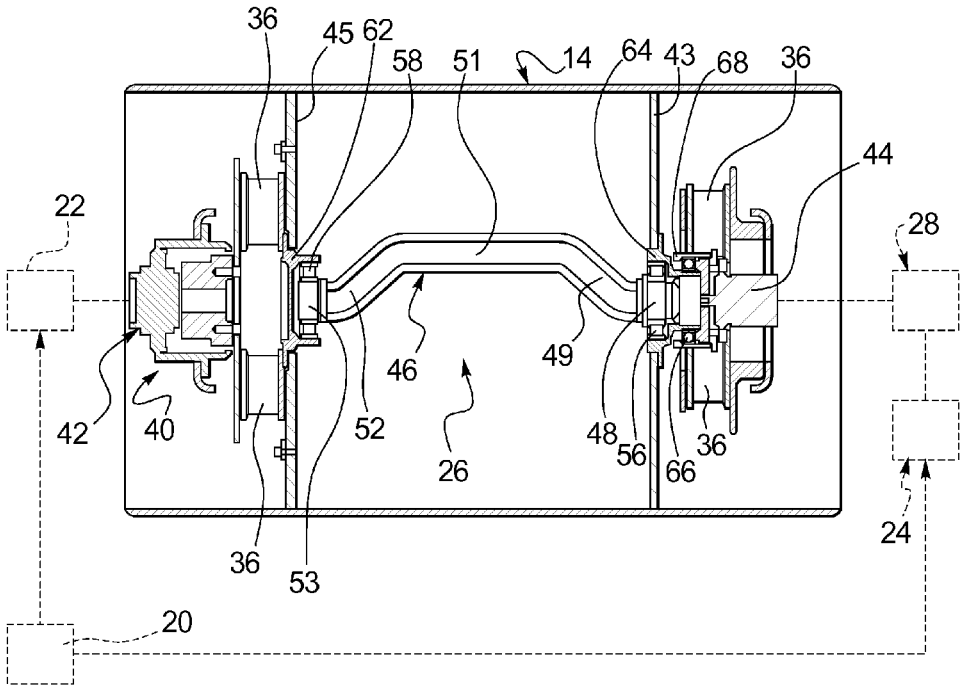
FIG. 3 is an enlarged sectional view of a single vibratory roller taken along line 3-3 of FIG. 2.

Referring to FIGS. 2 and 3, a work machine 10 for increasing the density of a compactable material 12 such as soil, roadway base aggregate, or asphalt paving material is shown.

The work machine 10 is, for example, a double roller vibratory compactor, also referred to as a utility compactor and having a first compacting roller 14 and a second compacting roller 16 rotatably mounted on a main frame 18. The main frame 18 also supports an engine 20 that has first and second hydraulic pumps 22, 24 operatively and conventionally connected thereto.

The first compacting roller 14 includes a first vibratory mechanism 26 that is operatively connected to a first hydraulic motor 28. The second compacting roller 16 includes a second vibratory mechanism 30 that is operatively connected to a second hydraulic motor 42. In as much as the first compacting roller 14 and the second compacting roller 16 are structurally and operatively similar, the description, construction and elements comprising the first compacting roller 14, as shown in FIG. 3, equally applies to the second compacting roller 16. Therefore, no separate discussion will be presented to the second compacting roller 16.

Referring now to FIG. 3, the rubber mounts 36 isolate the compacting roller 14 from the main frame 18 and therefore isolate the main frame 18 from the vibrations generated by the action of the eccentric shaft 46 and the roller 14. Optionally, the compacting roller 14 may include a two-speed drive arrangement 40. The two-speed drive arrangement 40 may be a hydraulic motor 42 with a planetary reduction unit, not shown. The hydraulic motor 42 may be operatively connected by hoses or conduits (not shown) to the hydraulic pump 22. The hydraulic motor 42 may be connected to the main frame 18 and operatively connected to the first compacting roller 14. The hydraulic pump 22 supplies a pressurized operation fluid, such as oil or hydraulic fluid, to the hydraulic motor 42 for propelling the work machine 10.

The pump 24 may be operatively connected to the first hydraulic motor 28 by hoses or conduits, shown schematically in FIG. 3. A coupling 44 connects the first vibratory mechanism 26 to the first hydraulic motor 28. The first vibratory mechanism 26 includes an eccentric shaft 46 that may be powered by the first hydraulic motor 28 thereby imparting a vibratory force on the compacting roller 14 through the first and second vertical supports 43, 45. It should also be noted that pump 24 may be shifted between a high output and a low output for rotating the eccentric shaft 46 at a high frequency and a low frequency.

The coupling 44 is connected to a first rotor shaft 48 which, in turn, forms part of the eccentric shaft 46 and is connected to a first angled portion 49 of the eccentric shaft 46. The first angled portion 49 is connected to a center portion 51 which, in turn, is connected to a second angled portion 52. The second angled portion 52 is connected to a second rotor shaft 53. The first and second rotor shafts 48, 53 are accommodated within first and second bearings 56, 58 respectively and are coaxial with respect to each other. The first bearing 56 is accommodated within a first bracket 64 that is mounted on the first vertical support 43. The first bracket 64 passes through a third bearing 66 which supports the rubber mounts 36 as they rotate about the first bearing 56 and bearing housing 68 with the rotation of the coupling 44 under the power of the first hydraulic motor 28. The second bearing 58 is connected to the second vertical support 45 by way of the second bracket 62. Like the stationary first bracket 64, the second bracket 62 similarly does not rotate with respect to the second vertical support 45.

Figure 1:
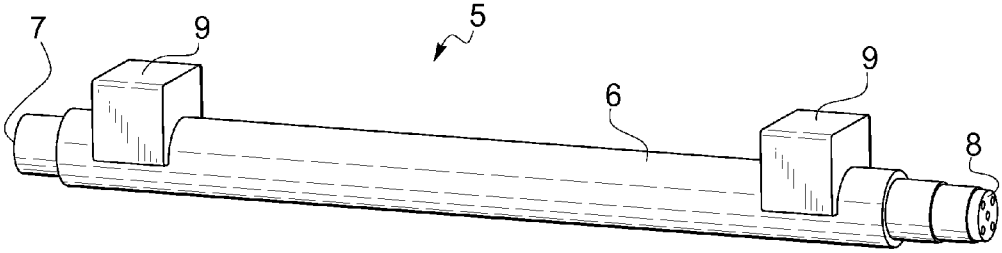
FIG. 1 is perspective view of a prior art eccentric vibratory weight shaft.
Figure 4:
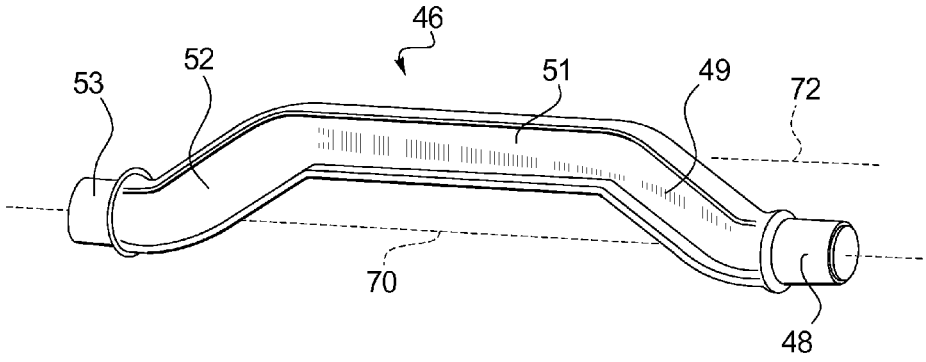
FIG. 4 is a perspective view of the eccentric vibratory weight shaft shown in FIG. 3.

One difference between the eccentric shaft 5 of FIG. 1 and the eccentric shaft 46 of FIGS. 3-4 is the ratios of the first to second moments of inertia. The second moment of inertia is a property of a cross section that can be used to predict the resistance of a beam to bending and deflection, around an axis that lies in the cross-sectional plane. The deflection of a beam under load depends not only on the load, but also on the geometry of the beam cross-section. In contrast, the first moment of inertia (or first moment of area) is based in the mathematical construct moments in metric spaces, wherein the first moment of inertia equals the summation of area multiplied by distance to an axis. The first moment of inertia is a measure of the distribution of the area of a shape in relationship to an axis.

It has been found that to minimize the start-up torque, weight and cost, the ratio of the first moment of inertia to the second moment of inertia should be maximized. For example, the ratio of the first moment of inertia to the second moment of inertia of one disclosed eccentric shaft 46 is about 13.4 $m^{-1}$, but can range from about 10 to about 16 $m^{-1}$, while ratio of the first moment of inertia to the second moment of inertia of the prior art shaft 5 is about 7.2 $m^{-1}$.

For a roller 14 having a width of about 1 m (40 in.), the eccentric shaft 46 of FIG. 4 weighs from about 6 to about 18 kg, with a preferred mass of about 9 kg, a first moment of inertia of about 0.21, a second moment of inertia of about 0.0157 $kg \cdot m^2$ and a ratio of first to second moments of inertia of about 13.4 $m^{-1}$, but can range from about 10 to about 16 $m^{-1}$. In contrast, the shaft 5 of FIG. 1 for the same size roller weighs about 26.2 kg, has a first moment of inertia of about 0.24, a second moment of inertia of about 0.335 $kg \cdot m^2$ and a ratio of first to second moments of inertia of about 7.2 $m^{-1}$. This vast difference in the ratios of the first to second moments of inertia substantially affects the torque required to initiate rotation of the shafts 5, 46. Specifically, the torque required to initiate rotation of the shaft 5 to a rotational frequency of 65 Hz over a 4 second start-up time period is about 3.42 N·m, while the torque required to initiate rotation of the lighter shaft 46 to the same frequency of 65 Hz over an identical 4 second start-up time period is only about 1.60 N·m. The reduction in start-up torque required to rotate the shaft 46 will not only save fuel, but will also reduce wear and tear on the motor 28 and pump 24.

Another difference between the shaft of FIG. 1 and the shaft 46 of FIGS. 3-4 is the offset between the first axis 70 that passes through the rotor shafts 48, 53 and a second axis 72 that passes through the center portion 51 of the shaft 46. This offset, for a roller 14 that is about 1 m wide, can range from about 27 to about 47 mm, with a preferred offset for a 1 m roller being about 37 mm. This offset enables the shaft 46 to provide the necessary inertia and vibrations, but with a much smaller moment of inertia. Smaller moment of inertia reduces the torque required to initiate rotation of the shaft 46, thereby saving energy and wear and tear on the moving components as discussed above.

INDUSTRIAL APPLICABILITY

During use of the work machine 10, an operator actuates the power source or hydraulic pump 24 so that the rollers 14, 16 rotate in the desired direction of travel. Rotating the rollers 14, 16 in this manner causes the work machine 10 to move in a forward or reverse direction over the material to be compacted.

At startup, before actually driving the work machine 10 onto the mat 12 be compacted, the operator request vibration from the user interface. This causes the controller (not shown) to command the power sources or hydraulic pumps 22, 24 to increase to full output. While the motors 28, 42 are accelerating, rotation of the vibratory mechanism 26 is initiated thereby causing the shaft 46 to rotate in an accelerated fashion until it reaches the operating frequency, e.g., 65 Hz. The start up time required to reach 65 Hz, or typical operating frequency, is about 4 seconds. The start-up can be easily achieved without undue wear and tear on the hydraulic motor 28 and hydraulic pump 24 of the work machine 10 as the reduced moment of inertia of the shaft 46 contributes substantially to this easy start up.

The disclosed shaft 46 may also be substituted for an existing shaft 5 without undue modification to an existing work machine 10.

What is claimed is:

1. An eccentric vibratory shaft comprising:

a first rotor shaft coaxially spaced apart from a second rotor shaft, the first and second rotor shafts being coupled together by an offset shaft;

the offset shaft including a first angled portion, a second angled portion and a center portion disposed between and coupling the first and second angled portions, the first angled portion being coupled to the first rotor shaft, the second angled portion being coupled to the second rotor shaft;

the first and second angled portions being angled with respect to a first axis passing through the first and second rotor shafts such that the center portion is offset from and at least substantially parallel to the first axis, wherein the offset shaft has an I-beam cross section, and wherein a ratio of a first moment of inertia to a second moment of inertia ranges from about 10 to about 16 $m^{-1}$.

2. The eccentric vibratory shaft of claim 1 wherein the center portion has a second axis spaced apart from the first axis by a distance ranging from about 27 to about 47 mm.

3. The eccentric vibratory shaft of claim 2 wherein the second axis is spaced apart from the first axis by about 37 mm.

4. The eccentric vibratory shaft of claim 1 wherein the mass ranges from about 6 to about 18 kg.

5. The eccentric vibratory shaft of claim 1 wherein the second axis is spaced apart from the first axis by a distance of about 37 mm and wherein a ratio of a first moment of inertia to a second moment of inertia is about 13.4 $m^{-1}$.

6. A utility compactor comprising:

a base plate;

a roller having two vertical supports;

an eccentric vibratory shaft extending between and rotatably connected to the two vertical supports of the roller, the eccentric vibratory shaft including a first rotor shaft coaxially spaced apart from a second rotor shaft, the first and second rotor shafts being coupled together by an offset shaft, the offset shaft having an I-beam cross section and including a first angled portion, a second angled portion and a center portion disposed between and coupling the first and second angled portions together, the first angled portion being coupled to the first rotor shaft, the second angled portion being coupled to the second rotor shaft, the first and second angled portions being angled with respect to a first axis passing through the first and second rotor shafts such that the center portion has a second axis that is offset from and at least substantially parallel to the first axis, wherein a ratio of a first moment of inertia to a second moment of inertia ranges from about 10 to about 16 $m^{-1}$.

7. The vibratory plate type compactor of claim 6 wherein the second axis is offset from the first axis by a distance ranging from about 27 to about 47 mm.

8. The utility compactor of claim 6 wherein the mass is about 9 kg wherein a ratio of a first moment of inertia to a second moment of inertia ranges from about 13.4 $m^{-1}$.

9. The utility compactor of claim 6 wherein the second axis is spaced apart from the first axis by a distance of about 37 mm and the shaft has a mass of about 9 kg.

10. A method of reducing a weight of a utility compactor and reducing a start-up torque required to rotate an eccentric vibratory shaft that vibrates a plate of the compactor, the method comprising:

providing an eccentric vibratory shaft including a first rotor shaft coaxially spaced apart from a second rotor shaft, the first and second rotor shafts being coupled together by an offset shaft, the offset shaft including a first angled portion, a second angled portion and a center portion disposed between and coupling the first and second angled portions together, the first angled portion being coupled to the first rotor shaft, the second angled portion being coupled to the second rotor shaft, the first and second angled portions being angled with respect to a first axis passing through the first and second rotor shafts such that the center portion is offset from and at least substantially parallel to the first axis, the offset shaft having an I-beam cross section and a ratio of a first moment of inertia to a second moment of inertia ranges from about 10 to about 16 $m^{-1}$;

removing a preexisting eccentric vibratory shaft from the compactor;

replacing the removed preexisting vibratory shaft with the provided eccentric vibratory shaft.

11. The method of claim 10 wherein the center portion has a second axis spaced apart from the first axis by a distance ranging from about 27 to about 47 mm.

12. The method of claim 11 wherein the second axis is spaced apart from the first axis by about 37 mm.

13. The method of claim 10 wherein the center portion has a second axis spaced apart from the first axis by a distance ranging from about 32 to about 43 mm.

* * * * *